United States Patent [19]

Leavy et al.

[11] 4,176,360

[45] Nov. 27, 1979

[54] ANTENNA DEPLOYMENT MECHANISM FOR USE WITH A SPACECRAFT

[75] Inventors: William A. Leavy; Charles R. Griffin, both of Bowie, Md.

[73] Assignee: The United States of America as represented by the Administrator of the National Aeronautics and Space Administration, Washington, D.C.

[21] Appl. No.: 943,088

[22] Filed: Sep. 18, 1978

[51] Int. Cl.[2] ..... H01Q 1/10; H01Q 1/12

[52] U.S. Cl. ..... 343/883; 343/880

[58] Field of Search ..... 343/880, 883, 900–904, 343/705; 52/116–118, 114, 632

[56] References Cited

U.S. PATENT DOCUMENTS

| | | | |
|---|---|---|---|
| 2,371,539 | 3/1945 | Morch | 343/883 |
| 3,503,072 | 3/1970 | Thompson | 343/883 |

FOREIGN PATENT DOCUMENTS

| | | | |
|---|---|---|---|
| 251028 | 2/1970 | U.S.S.R. | 343/883 |

*Primary Examiner*—David K. Moore

*Attorney, Agent, or Firm*—Robert D. Marchant; John R. Manning; John O. Tresansky

[57] ABSTRACT

A mechanical system is disclosed to deploy an antenna on a support which may, for example, be a spacecraft. A series of telescoping tubes are nested one within the other when the antenna is in a retracted stowed position. The outermost tube is rigidly attached to the support and the inner tubes are latched in the stowed position by a caging mechanism. The antenna is driven toward a deployed position by a dual motor driven cable which is terminated in a driving tube at the lower end of the innermost tube, from whence the cable is trained about pulleys at the tops and bottoms of successively large tubes of the antenna. The cable is wound on a drum at the lower end of the antenna and coaxial therewith. During deployment of the antenna, the drum rotates, thereby reeling in the deployment cable. The initial movement of the cable causes cam releasing of the latches in the caging device. Thereafter, the antenna tubes are extended until the final deployed position of the antenna is reached. A ratchet attached to the drum prevents reverse rotation of the drum and locks the antenna in the deployed position until the ratchet is released.

17 Claims, 10 Drawing Figures

FIG. 7
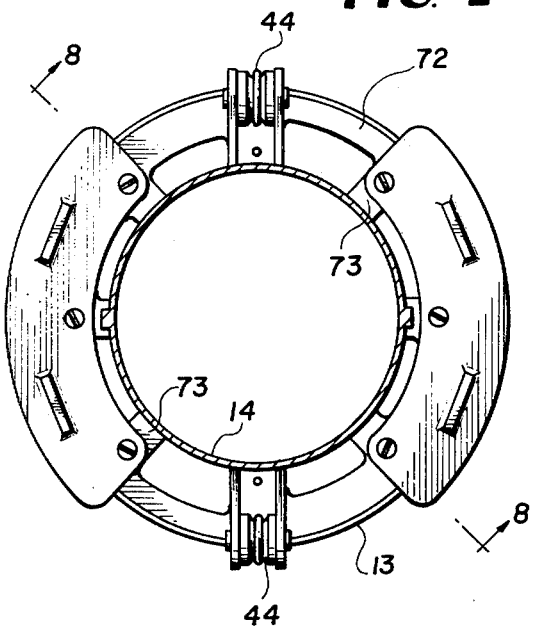
FIG. 8
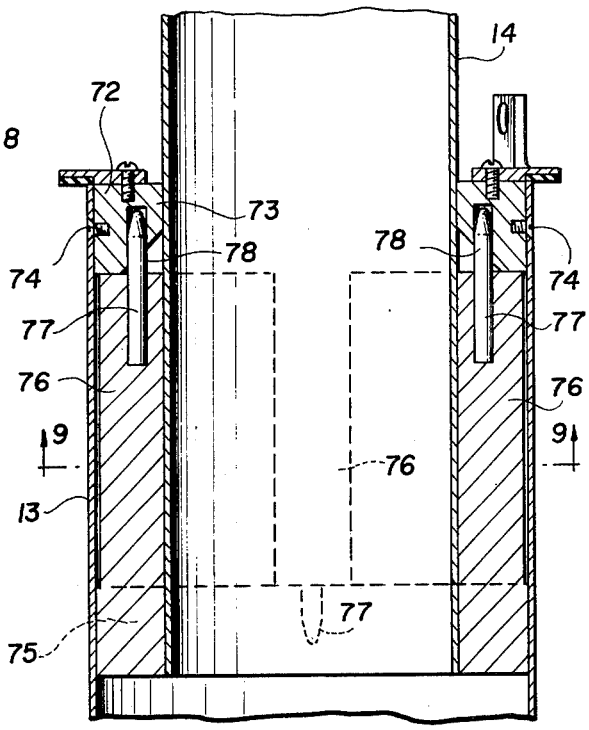
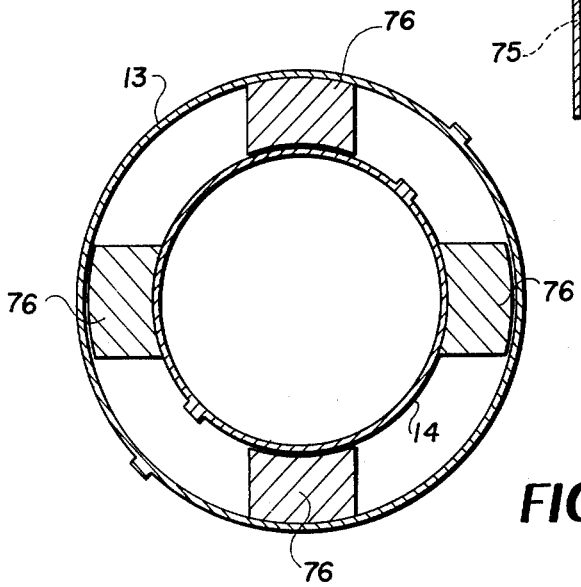
FIG. 9

ANTENNA DEPLOYMENT MECHANISM FOR USE WITH A SPACECRAFT

ORIGIN OF INVENTION

The invention described herein was made by employees of the United States Government and may be manufactured and used by or for the Government for governmental purposes without the payment of any royalties thereon or therefor.

BACKGROUND OF THE INVENTION

The invention relates generally to antennas, and more particularly to extensible and retractable antennas.

The known prior art indicates that antenna deployment systems utilizing telescoping sections are known. In addition, cable and pulley systems are known which are adapted to extend and retract the telescoping sections. Although locking and releasing devices for telescoping sections are known, the prior art is deficient in teaching devices that are used to hold all the sections in the retracted or extended positions. Also, pyrotechnic and fluid operators are known to be utilized in such apparatus; however, limitations inherently exist in the environment of outer space when a deployable antenna system is utilized in connection with a spacecraft. Also inherent limitation exists in known prior art apparatus where smooth-acting and reliable operation is required in a restricted or confined space. Thus, there is a requirement for an antenna deployment system that is adapted to overcome the shortcomings of the prior art while providing simple, compact and efficient power means to deploy the antenna while preventing a premature return of the structure to the retracted position.

Accordingly, it is an object of the present invention to provide a new and improved system for deploying and retracting an antenna.

It is another object of the present invention to provide a simple, compact, smooth-acting and reliable means for deploying an antenna in an inaccessible environment.

It is yet another object to provide a relatively simple but reliable cam-operated mechanism for caging and releasing a retracted antenna.

Still another object of the invention is to provide an antenna deployment and retracting mechanism which effectively prevents premature retraction of the antenna.

Other objects and advantages of the invention will become apparent during the course of the following description.

Briefly, the above and other objectives are attained in the invention by the provision of a plurality of telescoping tubes which are nested one within the other when the antenna is retracted. The outermost tube can be rigidly attached to any stable support. The interior tubes of the structure are latched in the stowed or retracted position by a cam operated latch-release mechanism which cooperates with a dual motor driven cable drive for the antenna tube sections which includes a cable winding drum below the movable sections of the antenna to initiate antenna deployment by causing automatic release of the cam operated latch-release mechanism. The cable is terminated within a driving anchor means in the form of a tube at the base of the innermost and smallest telescoping tube section. A ratchet device on the cable winding drum prevents reverse rotation of the drum until the ratchet device is manually uncoupled from the drum.

BRIEF DESCRIPTION OF THE DRAWINGS

FIG. 7 is an enlarged horizontal section taken on line 7—7 of FIG. 1;

FIG. 8 is a fragmentary central vertical section taken on line 8—8 of FIG. 7; and FIG. 9 is a horizontal section taken on line 9—9 of FIG. 8.

DESCRIPTION OF THE PREFERRED EMBODIMENT

Figure 1:
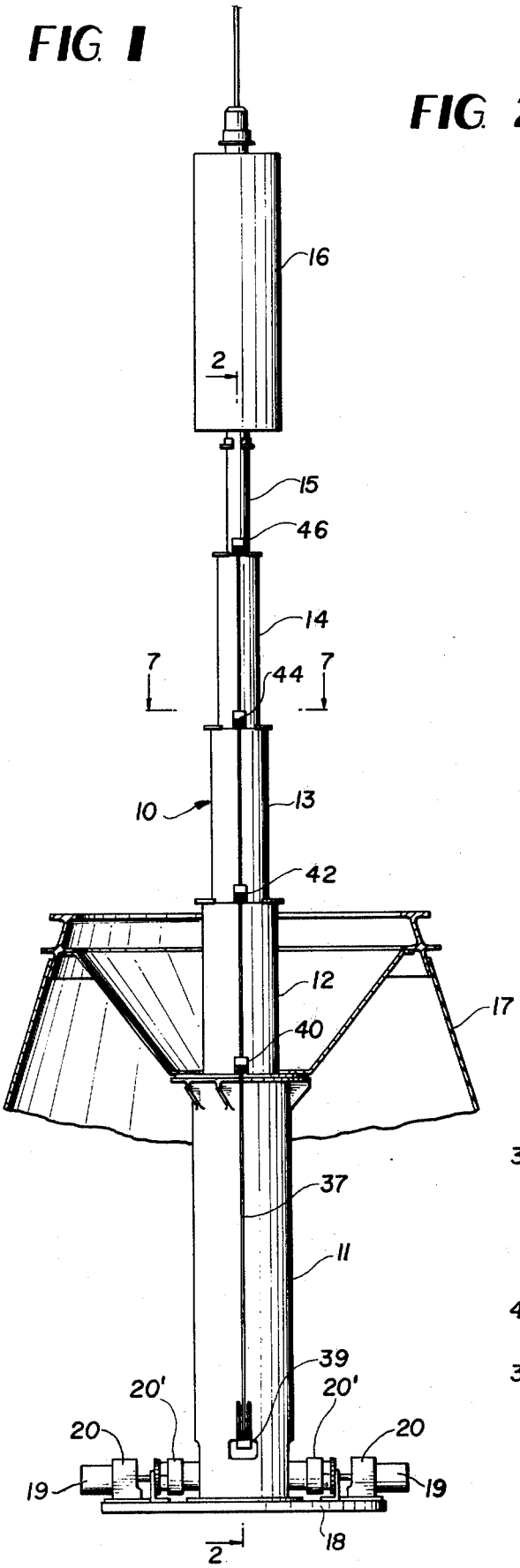
FIG. 1 is a side elevation of an antenna embodying the deployment mechanism of the invention and shown in a deployed position.
Figure 2:
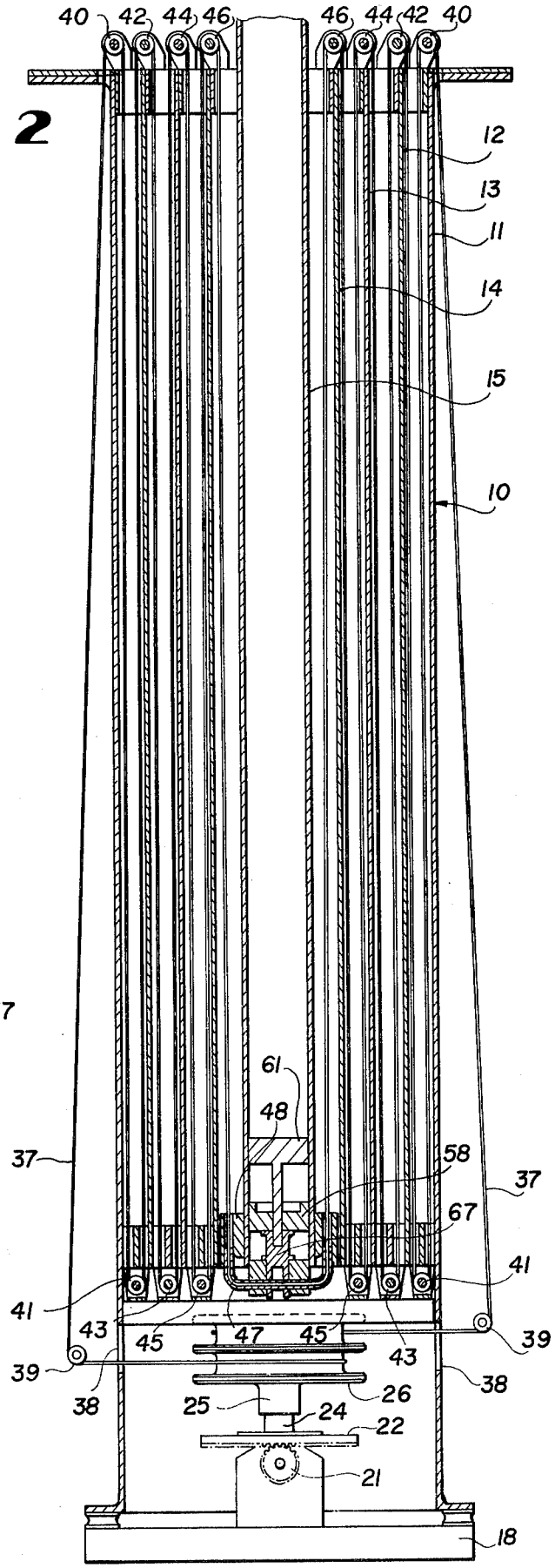
FIG. 2 is an enlarged central vertical section taken on line 2—2 of FIG. 1 showing the antenna in the stowed position.

Referring to the drawings in detail wherein like numerals designate like parts, an extensible and retractable telescopic antenna mast 10, FIG. 1, comprises a fixed or base section 11, plural successively smaller intermediate sections 12, 13 and 14, and an innermost smallest section 15 on which a suitable antenna body 16 is fixedly mounted. The mast sections 11 through 15 comprise thin walled cylindrical tubes which interfit telescopically when the antenna mast is fully retracted to a stowed position, as illustrated in FIG. 2.

The base section 11 of the antenna mast is fixed at its top to a spacecraft 17 or other stable support and is further attached through a lower end flange to a drive chassis 18 which mounts the antenna deployment drive mechanism. Such drive mechanism, FIG. 1, comprises dual drive motors 19, respective reduction gearing 20 and clutches 20' imparting to the drive a fail-safe capability in case of failure of one of the motors 19. Inside of mast base section 11, FIGS. 2 and 3, bevel gears 21 driven by clutch 20' mesh with and drive a larger bevel gear 22 arranged coaxially with the telescopic antenna mast. An anchor and guide element 23 fixed to the drive chassis 18 serves as a thrust bearing for the gear 22, FIG. 3, and also as a guidance means for a releasable ratchet device, to be described.

Figure 3:
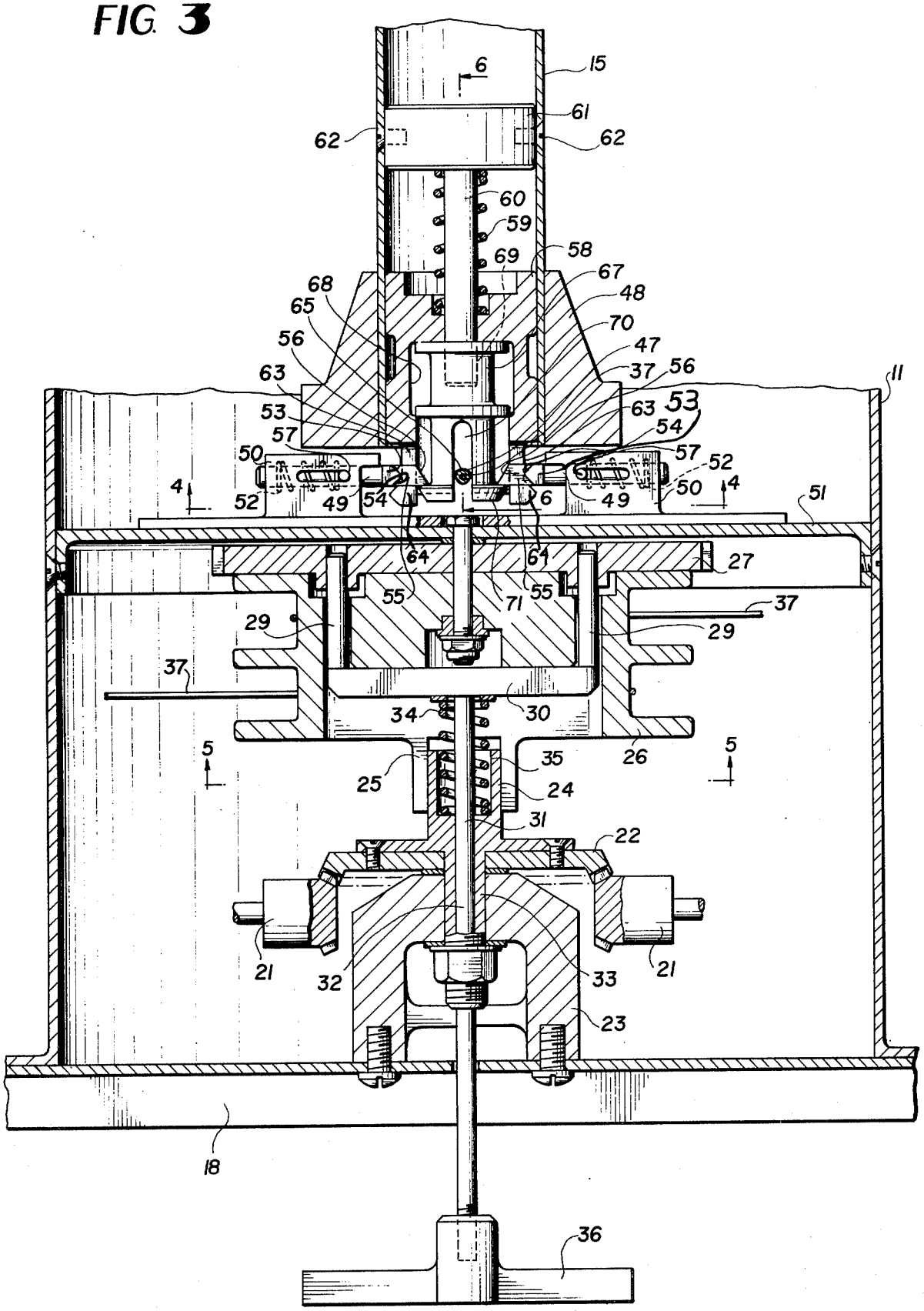
FIG. 3 is a further enlarged fragmentary vertical section taken at right angles to FIG. 2 through the cable winding drum, ratchet means and caging or latching means and associated elements.

The gear 22 carries a square cross section hub 24 which interfits telescopically within a square drive sleeve 25 depending from a double grooved deployment cable winding drum 26 which is rotationally driven by the gear 22. Associated with the drum 26 on the top thereof is a ratchet wheel 27 engaged by a spring-urged pawl 28, FIG. 5, suitably supported inside of the mast base section 11. The pawl 28 resists turning of the ratchet wheel in one direction while allowing free rotation thereof in the opposite direction. The ratchet wheel 27 is normally coupled to the drum 26 by two parallel pins 29 of a driving fork 30, the pins 29 passing through a pair of openings in the drum, as illustrated in FIG. 3.

The driving fork 30 is secured to an axially shiftable rod 31 passing slidably through a guide bore 32 formed in an extension 33 of the gear hub 24, the extension being rotatably received in a bore of the anchor and guide element 23. The pins 29 of drive fork 30 are normally biased into driving engagement with the ratchet wheel 27 by an expansible spring 34 resting in a cavity 35 of square cross section hub 24. The rod 31 is equipped below the drive chassis 18 with a retracting handle 36 by means of which the drive fork 30 can be uncoupled from the ratchet wheel 27 to allow reverse rotation thereof during retraction of the antenna mast.

A drive cable 37 for deploying the antenna is oppositely wound on the two grooves of the drum 26 and the cable extends in opposite directions from the drum, FIG. 2, through openings 38 in the mast base section 11 and around two exterior idler pulleys 39 suitably supported on the mast section 11 near and above its lower end. The cable 37 extends upwardly along the exterior of the antenna mast at diametrically opposite sides thereof and is reeved successively over pulleys 40, 41, 42, 43, 44, 45 and 46 at the opposite sides of the antenna mast. The pulleys 41, 43 and 45 are secured to the lower ends of mast sections 12, 13 and 14 and pulleys 40, 42, 44 and 46 are similarly secured to the upper ends of mast sections 11, 12, 13 and 14.

The innermost or smallest mast section 15 carries no pulleys for the drive cable 37. Instead, the interior stretches of the cable extend downwardly from the pulleys 46, FIG. 2, exteriorly of the mast section 15 and within the upper intermediate mast section 14. The ends of the cable 37 are terminated and firmly secured within a rigid U-shaped drive tube 47, FIGS. 2, 4 and 6, which is in turn fixed to an adapter head 48 rigid with the lower end of the innermost mast section 15. The cable ends may be anchored in the drive tube 47 in any preferred manner known in the art. It may now be noted that, when the drum 26 is rotated by the redundant drive to reel in the cable 37, the innermost mast section 15 will first be extended by the lifting or driving action of the U-shaped tube 47 which passes beneath the mast section 15.

Figure 4:
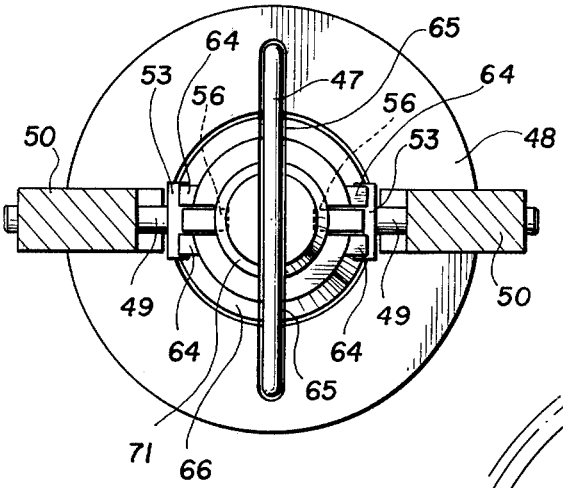
FIG. 4 is a horizontal section taken on line 4—4 of FIG. 3.
Figure 6:
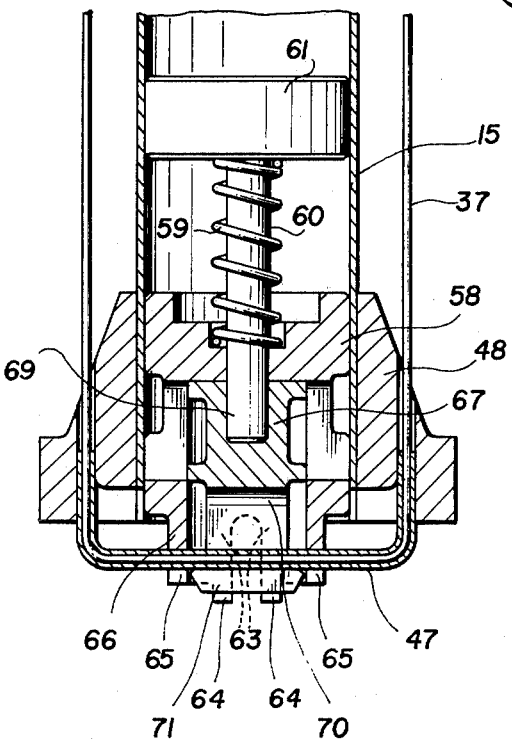
FIG. 6 is a fragmentary vertical section taken on line 6—6 of FIG. 3.
Figure 4A:
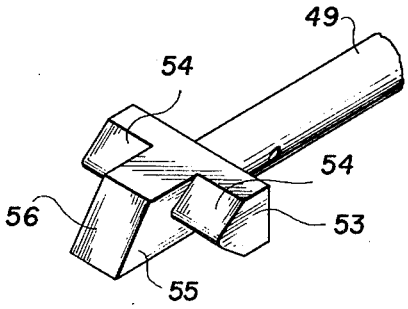
FIG. 4*a* is a perspective view of a latch bolt.

However, before the extension of the antenna mast 10 beginning with the innermost section 15 and followed by the intermediate sections 14, 13 and 12 can commence, a caging or latching means for the movable mast sections, now to be described, must first be released. This caging or latching means securing the antenna mast in its retracted position constitutes a very important part of the invention. Referring primarily to FIGS. 3, 4 and 6, a diametrically opposed pair of latch bolts 49 transverse to the antenna mast axis are mounted for simultaneous reciprocation in a pair of guide holders 50 fixedly secured to a support plate 51 secured within the mast base section 11 just above the ratchet wheel 27. The two latch bolts 49 are biased inwardly to active latching positions by expansion springs 52 within the holders 50, as illustrated. Inwardly of the holders 50 the two latch bolts have transverse camming heads 53 thereon whose top and bottom sides are beveled as at 54 for a purpose to be described. Inwardly of the camming heads 53, the two spring urged bolts have latching extensions 55, FIGS. 3 and 4*a*, which are steeply beveled on their upper sides to form inclined end faces 56. Inward movement of the two bolts 49 is limited by cross pins 57 extending through slots in the sides of holders 50, FIG. 3.

A first or exterior caging member 58, as shown in FIGS. 3 and 6, is engaged in the lower end portion of innermost mast section 15 and is biased downwardly therein by an expansible spring 59 surrounding the stem 60 of a piston-like head 61 secured by screws 62 fixedly in the mast section 15. At its lower end and below the bottom of mast section 15 and adapter head 48, the member 58 has depending divided extensions 63 terminating at their lower ends in pairs of spaced cam elements 64, FIGS. 3, 4 and 6, whose top and bottom faces are beveled to match the beveling of the faces 54 of bolt camming heads 53, FIG. 4*a*. As can be seen in FIGS. 3 and 6, the rigid drive tube 47 engages in relatively shallow tunnel slots 65 formed at diametrically opposite points in the lower skirt portion 66 of caging member 58. Thus, an upward movement of the drive tube 47 will raise or extend the member 58 axially in the innermost mast section 15 against the force of spring 59.

A second and interior spool-like caging member 67 is disposed within a cavity 68, FIGS. 3 and 6, of the exterior member 58 and the interior member 67 receives the lower end portion of stem 60 within a top bore 69 thereof. The two members 58 and 67 can have relative motion in the axial direction during the operation of the latching means, as will be further described. The interior caging member 67 is provided in its lower end and in alignment with the tunnel slots 65 with a considerably longer tunnel slot 70 through which the bottom of the U-shaped drive tube 47 also extends, FIGS. 3 and 6, to form a lost motion connection between the elements 58 and 67 in relation to the drive tube 47. That is to say, when the drive tube 47 begins to elevate or move outwardly responsive to rotation of the drum 26 and reeling of cable 37, it will first shift the exterior member 58 having the shallow grooves 65 axially outwardly in mast section 15 sufficiently to cause the beveled cam elements 64 to engage the beveled camming heads 53 of latch bolts 49 and shift the latch bolts outwardly to release positions relative to the interior caging member 67. When the latch bolts 49 are in their innermost active positions shown in the drawings, their inner ends overlap and lock down a downwardly tapered latching head 71 formed on the lower end of the member 67 inwardly of the divided extensions 63 and cam elements 64. This latching head 71 is released when the two bolts 49 are cammed outwardly by the initial upward movement of the outer member 58 responsive to initial movement of the drive tube 47 upwardly in the tunnel slot 70.

Once the two latch bolts 49 are moved outwardly by cam elements 64 to the point that caging member 67 is released, the compressive force that has built up in spring 59, and which was heretofore reacted by the latch bolts 49, is suddenly applied to mast section 15 through head 61. This force causes mast section 15 to rapidly move axially a short distance until the compressive load in spring 59 is relieved to an equilibrium level. Further upward movement of the drive tube 47 causes the extension of the innermost mast section 15, followed in succession by the outward movement of intermediate mast sections 14, 13 and 12 until the antenna mast is fully deployed as depicted in FIG. 1.

Figure 5:
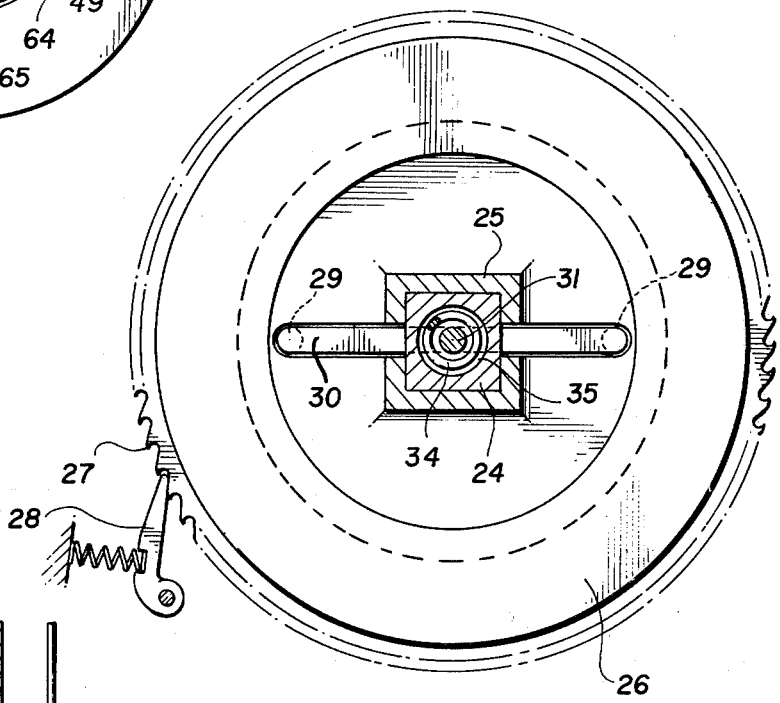
FIG. 5 is a horizontal section taken on line 5—5 of FIG. 3.

During such deployment, the ratchet wheel 27 is positively coupled to the drum 26, as shown in FIGS. 3 and 5, and rotates with the drum, the pawl 28 simply skipping over the ratchet wheel teeth during the deployment of the antenna mast but resisting reverse movement of the pawl and drum and thus locking the mast in the fully deployed or extended position. When it is desired to retract the mast to its stowed position, FIG. 2, the handle 36, FIG. 3, is grasped and the driving fork 30 is uncoupled from the ratchet wheel 27 so that the latter cannot resist the retraction of the mast, either manually or by power means if that is desired. During retraction, the several telescoping mast sections return to their nested positions shown in FIG. 2 and, as a result of this, the drive cable 37 is unwound from the drum 26 which freewheels. The described caging means for the retracted antenna returns automatically to the active position shown in FIG. 3 through interaction of the several beveled camming faces.

A further feature of the invention illustrated in FIGS. 7–9 concerns means to positively interlock the several tubular sections of the antenna mast and stabilize them when the mast is deployed. Each mast movable section has a thick rigid ring or collar 72 including multiple circumferentially spaced bearing lands 73 fixed within its upper end portion by screws 74 or the like, FIG. 8. The bearing lands 73 afford smooth guidance without binding of the next interior telescoping mast section. Similarly, each movable mast section has an external collar 75 fixed to the lower end thereof and slidably engaging the bore of the next outermost mast section such as the section 13. The respective collars or rings 73 and 72 include axially oppositely extending interdigitating extensions 76 preferably spaced apart circumferentially ninety degrees as shown in FIG. 9. The ends of the extensions 76 carry pilot pins 77 which enter locator openings 78 formed in the opposing collar of the adjacent telescoping mast section. In addition to locking and positioning the telescoping mast sections in their deployed positions, the described arrangement adds strength and stiffness to the thin walled tubes of the mast without adding significantly to the weight of the structure.

The antenna structure contains other details, some of which are shown in the drawings but which are not pertinent to the claimed invention and therefore need not be described for a complete understanding of the invention.

In summation, therefore, the invention embodies a wholly mechanical system for powering a multi-section telescopic antenna mast on a spacecraft or the like to a deployed position and releasably locking the mast in the deployed position. The system additionally includes a cam-actuated caging or latching means to secure the antenna mast in its fully retracted position and this latter means possesses a unique lost motion operational mode whereby initial reeling in of the drive cable on the drum 26 first cams the caging latch bolts to release positions followed by outward movement of the innermost or smallest mast section 15 in response to continued movement of the rigid U-shaped drive tube 47. The mechanism is highly compact and very reliable, as well as lightweight and of comparatively low cost. The advantages of the invention over the prior art should now be apparent to those skilled in the art.

While a preferred embodiment of the invention has been shown and described, it is to be understood that such description is made by way of illustration only and not in a limiting sense. Accordingly, it is to be further understood that conventional and obvious substitutions, modifications and reversals of parts may be resorted to without departing from the spirit or scope of the invention defined by the subjoined claims.

What is claimed is:

1. In an antenna structure, a relatively stationary support, a multi-section extensible and retractable antenna mast including base, intermediate mast sections and an innermost mast section having telescoping engagement, the base section of said antenna mast being fixed to said support, power drive means connected with said base section and including a rotary drum, a flexible element engaging said drum and windable thereon and being reeved over guide elements of the base and intermediate antenna mast sections, a terminal member for the ends of said flexible element and fixed thereto and spanning the interior end of the innermost mast section and adapted to drive the innermost mast section outwardly to a deployed position when the flexible element is wound on said drum, a caging means for said innermost mast section including at least a bolt on said base section having cam faces and extending transversely of the antenna mast axis, and a cooperating two part latch on the innermost mast section including a yielding lost motion connection between the two parts of the latch, and said terminal member being engaged drivingly with one of said two parts to effect relative movement between the two parts during initial winding of the flexible element on said drum, and said two parts having camming faces for cooperation with said cam faces of said bolt to automatically release the caging means during deployment of the antenna structure.

2. In an antenna structure as defined in claim 1, and a releasable one-way active holding means for said drum coupled therewith and preventing retrograde rotation of the drum prior to release, whereby the antenna mast is locked in its deployed position by said holding means.

3. In an antenna structure as defined in claim 2, and said one-way active holding means comprising a ratchet wheel adjacent to one end face of the drum having teeth for cooperation with a spring-urged pawl, and a manually releasable coupling means drivingly connecting said drum and ratchet wheel.

4. In an antenna structure as defined in claim 3, and said drum and ratchet wheel being coaxial with the antenna mast, said manually releasable coupling means comprising a spring-urged rigid coupler having a release handle extending exteriorly of the antenna mast.

5. In an antenna structure as defined in claim 4, and said spring-urged rigid coupler comprising a coupling fork including spaced elements received in coaxial drive openings of said drum and ratchet wheel, said release handle including a member coaxial with said drum and ratchet wheel and secured to the coupling fork.

6. In an antenna structure as defined in claim 1, and guide bearing means on said antenna mast sections near the ends of such sections and having opposing axially extending circumferentially spaced interdigitating parts to stabilize and strengthen the mast sections, the mast sections comprising comparatively thin walled tubes.

7. In an antenna structure as defined in claim 6, and axially extending pilot and locator pins on said interdigitating parts adapted to enter locator openings formed in the opposing guide bearing means of said mast sections.

8. In an antenna structure as defined in claim 6, and said guide bearing means comprising ring bodies on the interior and exterior of adjacent antenna mast sections and carrying said interdigitating parts.

9. In an antenna structure as defined in claim 1, and said relatively stationary support comprising a spacecraft body portion.

10. In an antenna structure as defined in claim 1, and said power drive means comprising a redundant drive means connected with and driving said rotary drum and imparting to the antenna structure a fail-safe capability.

11. In an antenna structure as defined in claim 1, and said guide elements of the base and intermediate antenna mast sections comprising pulleys on the ends of said mast sections, said mast sections comprising tubes.

12. In an antenna structure as defined in claim 1, and said terminal member comprising a substantially rigid tube receiving end portions of said flexible element, and the two parts of said latch on the innermost mast section having tunnel passages formed therein across the axis of the antenna mast and forming said lost motion connection between said two parts.

13. In an antenna structure as defined in claim 12, and said two parts of said latch comprising telescoping parts within the bore of the innermost mast section, and a spring engaging one of said two parts and connected with the innermost mast section.

14. In an antenna structure as defined in claim 12, and said two parts of said latch comprising telescopically interfitting parts coaxial with the innermost mast section, the outermost of said two parts containing a relatively shallow tunnel passage in its interior end and the innermost part having a comparatively deep tunnel passage across its interior end, both tunnel passages receiving said substantially rigid tube therethrough across the axis of the antenna mast.

15. In an antenna structure as defined in claim 14, and said caging means further comprising a pair of diametrically opposing bolts on said base section each having upper and lower beveled cam faces for cooperation with correspondingly beveled cam faces on the outermost of said two parts of said latch.

16. In an antenna structure as defined in claim 15, and the innermost of said two parts of the latch having a beveled cam face at its interior end, and leading extensions on said bolts having upper beveled faces for cooperation with the last-named beveled cam face.

17. In an antenna structure as defined in claim 16, and each of said bolts comprising a crosshead rearwardly of its leading extension, and said upper and lower beveled cam faces being formed on said crosshead, the interior end of the innermost of said two parts of said latch being bifurcated to receive said leading extensions.

* * * * *